United States Patent [19]

Tanaka et al.

[11] Patent Number: 5,009,084

[45] Date of Patent: Apr. 23, 1991

[54] REFRIGERATOR

[75] Inventors: Syozo Tanaka, Nara; Akiro Takushima, Yamatotakada; Yoshiharu Shinobu, Kashiwara; Masaki Eguchi, Nara, all of Japan

[73] Assignee: Sharp Kabushiki Kaisha, Osaka, Japan

[21] Appl. No.: 506,785

[22] Filed: Apr. 10, 1990

[30] Foreign Application Priority Data

Apr. 13, 1989 [JP] Japan ..... 1-44152

[51] Int. Cl.[5] ..... F25D 11/02

[52] U.S. Cl. ..... 62/441; 62/DIG. 13

[58] Field of Search ..... 62/441, DIG. 13

[56] References Cited

U.S. PATENT DOCUMENTS 3,090,209 5/1963 Hubacker ..... 62/441 X
3,455,119 7/1969 Bright ..... 62/441 X
4,768,353 9/1988 Bushser ..... 62/441 X
4,788,832 12/1988 Aoki et al. ..... 62/441 X

*Primary Examiner*—Lloyd L. King
*Attorney, Agent, or Firm*—Nixon & Vanderhye

[57] ABSTRACT

A refrigerator which includes cooling chamber including a refrigerating chamber and a freezing chamber, an axial flow fan for circulating air within the cooling chamber, a heat exchanger for cooling the air circulated by the axial flow fan, a suction side space so formed as to guide the air cooled by the heat exchanger from the heat-exchanger to the axial flow fan, and a sound absorbing material for absorbing noises produced in the suction side space and the cooling chamber so as not to leak outside the refrigerator, with the suction side space and the cooling chamber respectively having resonance dimensions for resonation at specific frequency regions. The suction side space is set, in its resonance dimension, to the frequency region at which the sound absorbing material can absorb the sound in an efficient manner.

6 Claims, 4 Drawing Sheets

REFRIGERATOR

BACKGROUND OF THE INVENTION

The present invention generally relates to a refrigerator, and more particularly, to reduction of noises produced during operation of the refrigerator.

Recently, most refrigerators are produced in a two-door type or three door type having, for example, a freezing chamber and refrigerating chamber, etc. so that the cooling temperature may be divided according to objects for use.

Commonly, as shown in FIG. 5, the refrigerator R of the above described type has a freezing chamber 1 to provide the lowest temperature at the uppermost portion thereof. The freezing chamber 1 has a door 12 pivotally provided at its front side for selective opening and closing of said chamber, while, at the back side of the freezing chamber 1, there is provided a blasting louver 5 formed with blasting holes 14 for sending out cooled air into the freezing chamber 1. Behind said blasting louver 5, a fan fixing plate 10 on which an axial flow fan 3 is fixed, is provided. Below the axial flow fan 3 referred to above, a heat exchanger 4 is disposed in a suction side space 7 defined between the fan fixing plate 10 and the inner wall surface of a rear panel 9 of the refrigerator R. Meanwhile, in the freezing chamber 1 in a bottom wall under the door 12, an opening 13 is formed to be communicated with the heat exchanger 4.

By the above arrangement, air in the above refrigerator R is adapted to be normally circulated by the axial flow fan 3 as indicated by arrows. Accordingly, the interior of the refrigerator R can be maintained at predetermined low temperatures as the air is cooled by the refrigerator 4 as it is circulated in the manner as described above.

Incidentally, the air referred to above is formed with turbulence in its flow when sent out by the axial flow fan 3 so as to be turbulent flow, because an air suck-in portion of the axial flow fan 3 is limited at the lower portion, with the blasting louver 5 being provided before the blasting portion. Thus, the air in the form of the turbulent flow as described above is producing the so-called turbulent noise having a wide range of frequency region.

The above turbulent noise tends to readily induce resonance, since the interior of the freezing chamber 1 and the suction side space 7 have a resonance frequency Fr represented by a following equation.

$$Fr = n \cdot C/(2 \cdot L) \quad (1)$$

wherein C is a speed of sound (m/s), L is a resonance dimension (m), and n is an integer (1,2 . . . ).

By the above fact, the suction side space 7 is to have a resonance frequency Fr determined by the resonance frequency L as shown in FIG. 6, and the resonance referred to above becomes a main factor which increases the noise during operation of the refrigerator.

Accordingly, as shown in FIG. 5, on the outer walls of the freezing chamber 1, layers of a sound absorbing material 6 are provided for preventing the noises generated inside the freezing chamber 1 and the suction side space 7, from leaking out of the refrigerator R. For the above sound absorbing material 6, a porous material, e.g. glass wool, felt or the like is employed, whereby the noises produced in the freezing chamber 1 and the suction side space 7 of the refrigerator R may be lowered.

However, in the conventional refrigerators as described so far, it is still difficult to sufficiently suppress the noises generated within the freezing chamber 1 and the suction side space 7, due to the fact that the above noises have a wide range of frequency regions, whereas the sound absorbing material commonly employed has a superior sound absorbing coefficient only above certain frequencies, e.g. 600 Hz. In other words, in the conventional refrigerators as described so far, since the frequency regions of the noises are not fully in agreement with the frequency regions of the sound absorbing material 6 for absorbing such noises, said noises tend to leak out of the refrigerator R.

Accordingly, in a refrigerator, if it is intended to fully reduce the noises generated within the freezing chamber 1 and the suction side space 7, it is necessary to largely increase the thickness of each layer of the sound absorbing material 6 or to use a sound absorbing material made of a special material superior in sound absorbing characteristics if it is thin in the thickness of its layer.

In the case where the thickness of the layer of the sound absorbing material is increased to a large extent, there is brought about such a problem that it becomes necessary to increase external dimensions of the refrigerator, or to reduce the volume of the freezing chamber 1. On the other hand, when the sound absorbing material of a special quality superior in the sound absorbing characteristics even if its layer is thin, is employed, another problem is involved such as cost increase of the refrigerator on the whole, since the sound absorbing material of the particular quality is generally expensive.

SUMMARY OF THE INVENTION

Accordingly, an essential object of the present invention is to provide a refrigerator which is capable of reducing noises thereof without involving any cost increase by arranging to sufficiently lower leakage of noises generated in its suction side space during operation, out of the refrigerator, without a large increase of the layer thickness of the sound absorbing material or employment of a special expensive sound absorbing material.

Another object the present invention is to provide a refrigerator of the above described type which is simple in construction and stable in functioning at high reliability.

In accomplishing these and other objects, according to one preferred embodiment of the present invention, there is provided a refrigerator which includes a cooling chamber including a refrigerating chamber and a freezing chamber, a send-out means for circulating air within said cooling chamber, a heat exchanger for cooling the air circulated by said send-out means, a suction side space so formed as to guide the air cooled by the heat exchanger from said heat-exchanger to the send-out means, and a sound absorbing material for absorbing noises produced in said suction side space and said cooling chamber so as not to leak outside the refrigerator, with said suction side space and said cooling chamber respectively having resonance dimensions for resonation at specific frequency regions. The suction side space is set, in its resonance dimension, to the frequency region at which the sound absorbing material can absorb the sound in an efficient manner.

In the arrangement according to the present invention as described above, the turbulent noise is produced when the send-out means causes the air within the cooling chamber to circulate. Such turbulent noise has a wide range of frequency regions, and also includes the frequency regions for resonation of the cooling chamber and the suction side space. Therefore, in the cooling chamber and the suction side space, noises tend to be increased by the excitation of resonance.

It is quite possible that the resonance dimension of the cooling chamber is varied by the configurations and volumes of food items, etc. preserved within said cooling chamber. On the other hand, the suction side space may be set constant in its resonance dimension, since the configuration and volume thereof can be held constant. Accordingly, the noise generated at the suction side space may be prevented from being leaked outside the refrigerator by setting the resonance frequency of said suction side space at the frequency region which may be efficiently absorbed by the sound absorbing material.

As described above, in the refrigerator according to the present invention, leakage of the noises generated at the suction side space during operation, out of the generator can be fully reduced, without necessity for a large increase of the layer thickness of the sound absorbing material or for employment of a special sound absorbing material which may invite cost increase.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
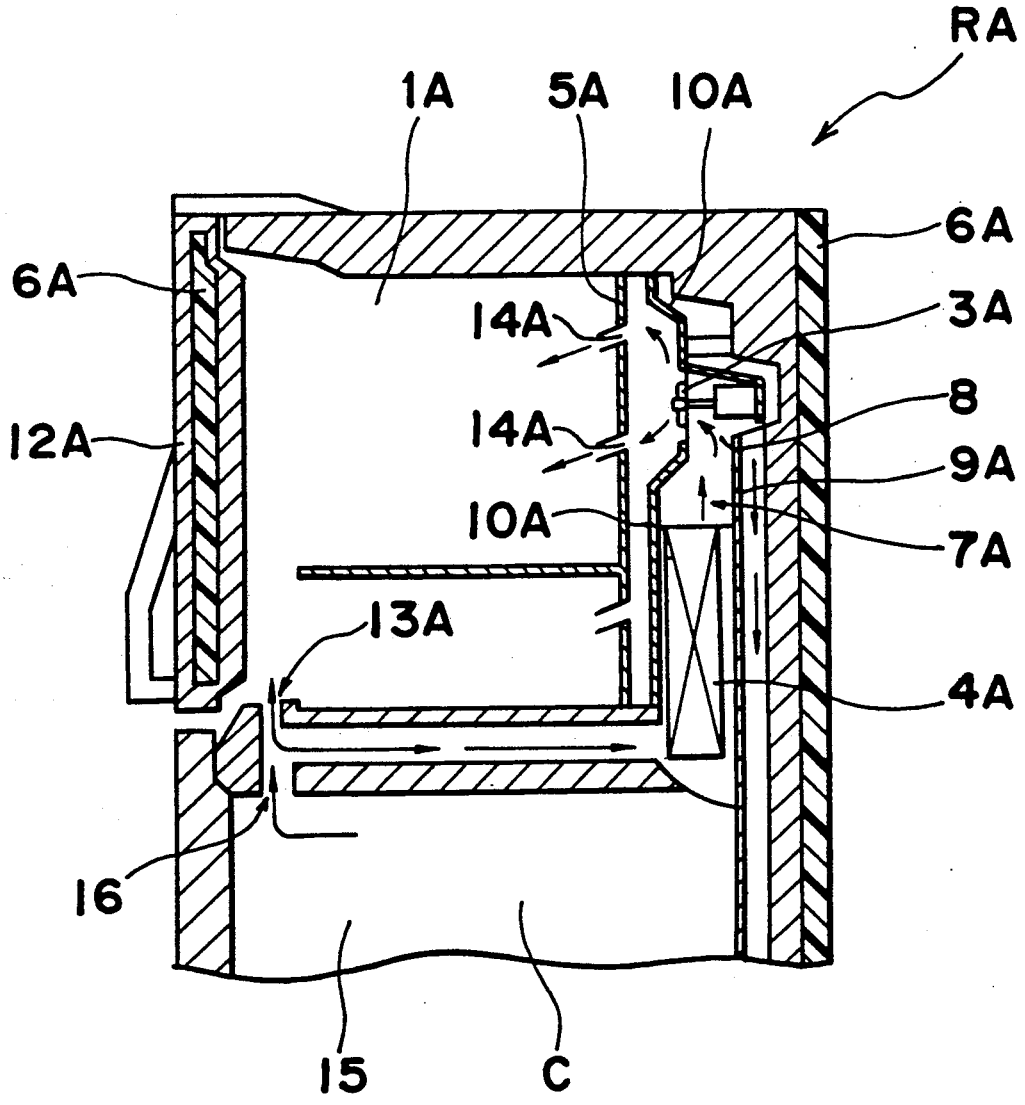
FIG. 1 is a fragmentary side sectional view at an upper portion of a refrigerator according to one preferred embodiment of the present invention.

Before the description of the present invention proceeds, it is to be noted that like parts are designated by like reference numerals throughout the accompanying drawings.

Figure 2:
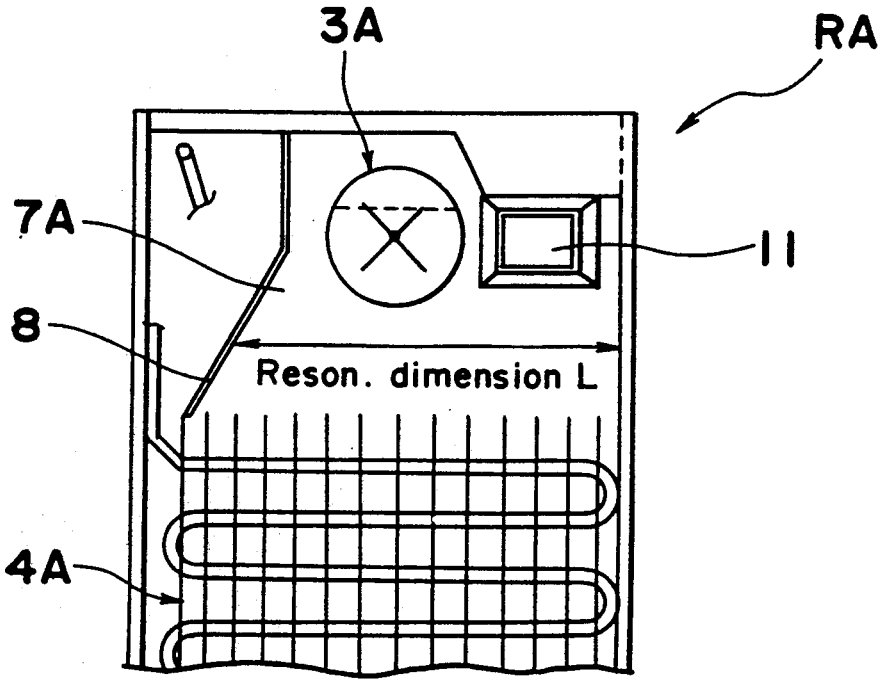
FIG. 2 is a fragmentary front elevational view schematically showing construction in the vicinity of a suction side space of the refrigerator of FIG. 1.
Figure 3:
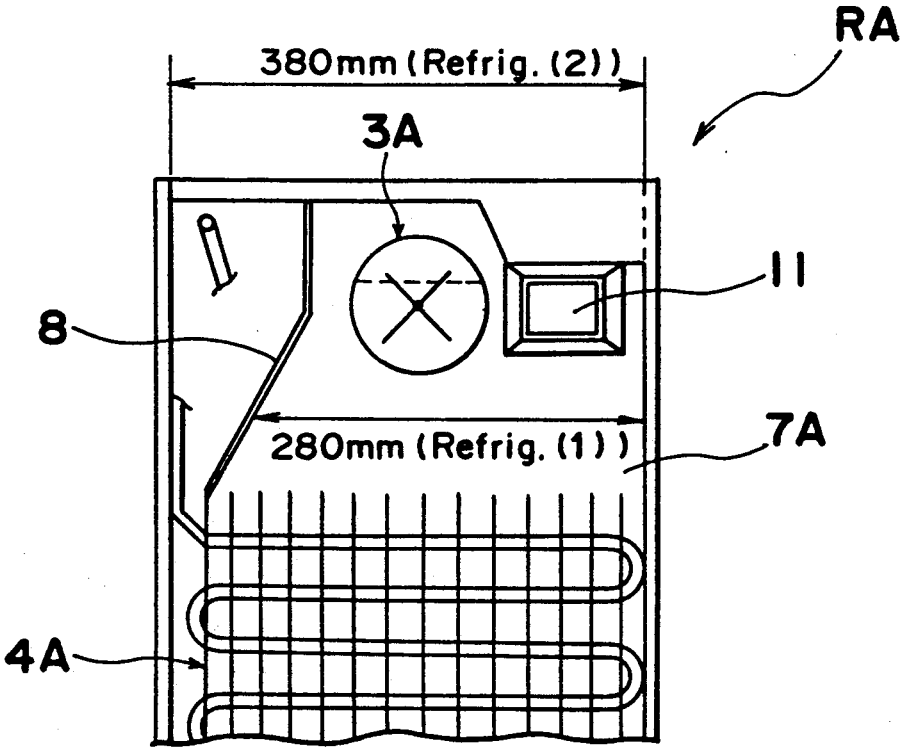
FIG. 3 is a view similar to FIG. 2, which particularly shows actual dimensions adopted for experiments.

Referring now to the drawings, there is shown in FIGS. 1 to 3, a refrigerator RA according to one preferred embodiment of the present invention.

Figure 5:
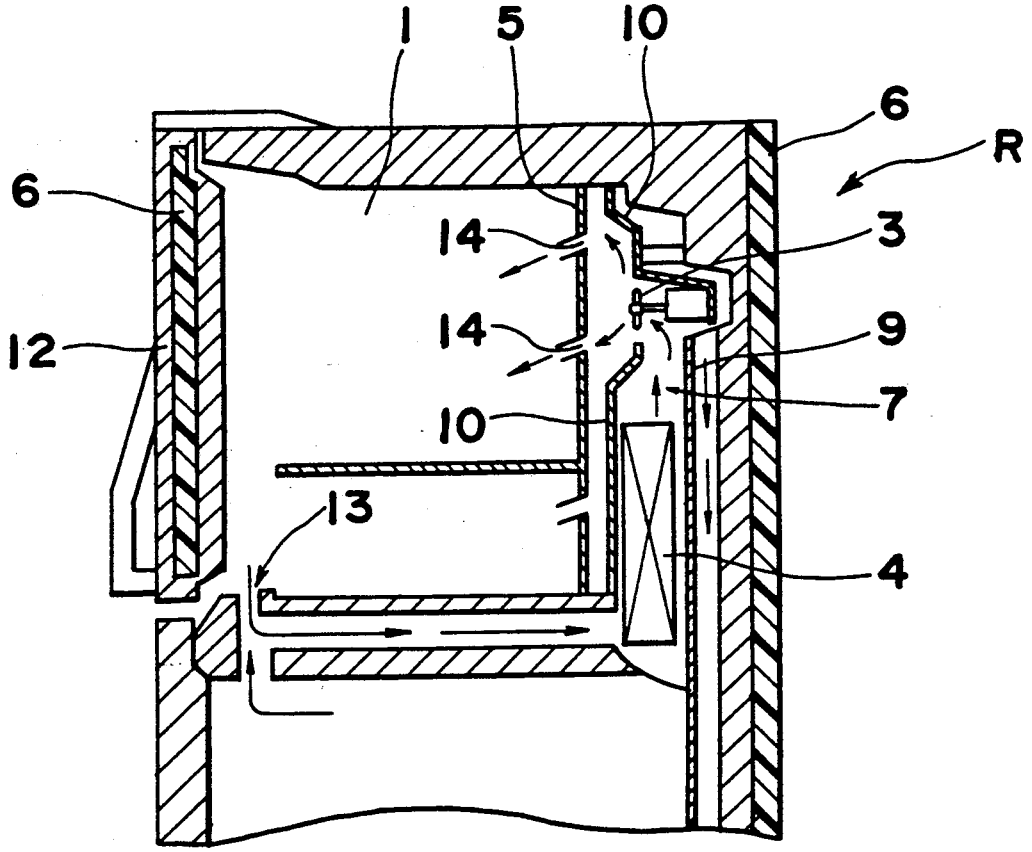
Fig. 5 PRIOR ART
FIG. 5 is a view similar to FIG. 1, which particularly relates to a conventional refrigerator (already referred to)
Figure 6:
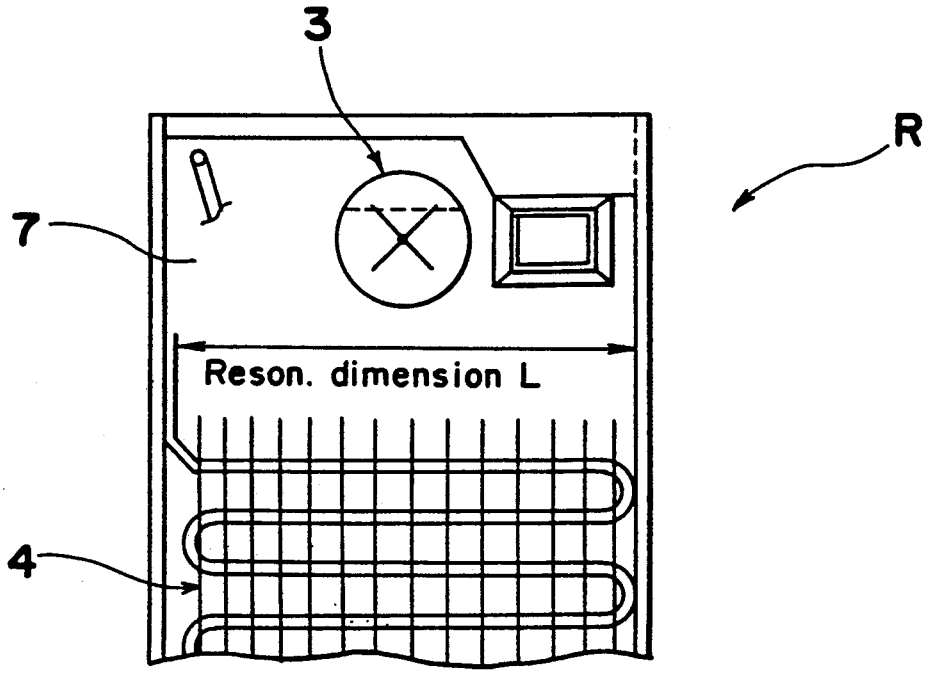
Fig. 6 PRIOR ART
FIG. 6 is also a view similar to FIG. 2, which particularly relates to the conventional refrigerator of FIG. 5 (already referred to).

In the first place, it is to be noted that in the embodiment of FIGS. 1 to 3, like parts in the conventional refrigerator R of FIGS. 5 and 6 are denoted by like reference numerals with symbols A affixed thereto for brevity of explanation.

As shown in FIG. 1, in the similar manner as in the conventional refrigerator R of FIGS. 5 and 6, the refrigerator RA of the present invention also has a freezing chamber 1A as a cooling chamber C to provide the lowest temperature at its uppermost portion. On the outer walls of the freezing chamber 1A, layers of a sound absorbing material 6A, for example, of porous materials such as glass wool, felt, expanded polyurethane or the like, and an iron plate, etc. are provided.

At the front face side of the freezing chamber 1A, a door 12A is pivotally provided for selective opening or closing, while, at the back side of the freezing chamber 1A, there is provided a blasting louver 5A formed with a blasting holes 14A for sending out the cooled air into the refrigerating chamber 1A. Behind said blasting louver 5A, a fan fixing plate 10A is provided, on which an axial flow fan 3A as a send-out means is fixed. Moreover, on the above fan fixing plate 10A, a refrigerating chamber blasting port 11 is formed beside the axial flow fan 10A as illustrated in FIG. 2. Said blasting port 11 is communicated with a refrigerating chamber 15 as the cooling chamber located below the freezing chamber 1A, whereby air raised in pressure by the axial flow fan 3A is to be distributed into the freezing chamber 1A and the refrigerating chamber 15.

Under the above axial flow fan 3A, a suction side space 7A is defined between the fan fixing plate 10A and the inner wall surface of a rear panel 9A of the refrigerator RA, and in said suction side space 7A, a heat exchanger 4A is provided for cooling air.

Furthermore, in the above suction side space 7A, there is provided a partition plate 8 for reducing noises produced in said space 7A as shown in FIG. 2 so as to extend from the fan fixing plate 10A to the rear panel inner wall 9A in a direction of depth of the refrigerator RA.

The partition plate 8 referred to above has its one edge or upper edge contacting the upper outer wall of the freezing chamber 1A in a position at the side opposite to the refrigerating chamber blasting port 11 with respect to the axial flow fan 3A located at an intermediate portion therebetween, and is depending perpendicularly therefrom so as to be bent in a direction away from the refrigerating chamber blasting port 11 at a position where it reaches approximately the same position as that of the axial flow fan 3A, while the other edge or lower edge of said partition plate 8 contacts the upper end portion of said heat exchanger 4A, whereby air passing through the heat exchanger 4A is adapted to flow, with influence by said partition plate 8A being suppressed to minimum.

Moreover, in the freezing chamber 1A in a bottom wall under the door 12A, there is formed an opening 13A for communication with the heat exchanger 4A. Meanwhile, below said freezing chamber 1A, a refrigerating chamber 15 is provided, with an opening 16 being formed on the upper wall of said chamber 15. This opening 16 is also communicated with the heat exchanger 4A through a similar passage to that of the opening 13.

By the above arrangement, as shown in FIG. 3, measurements were taken on the noise spectra which are sound pressure levels (dBA) at respective frequencies and noise values (dBA) for a refrigerator having a suction side space 7A in which the resonance dimension L is set at 280 mm by the partition plate 8 (referred to as the refrigerator (1) hereinafter), and another refrigerator having a suction side space 7A in which the resonance dimension L is set at 380 mm without employing the partition plate 8 (referred to as the refrigerator (2) hereinafter).

Figure 4:
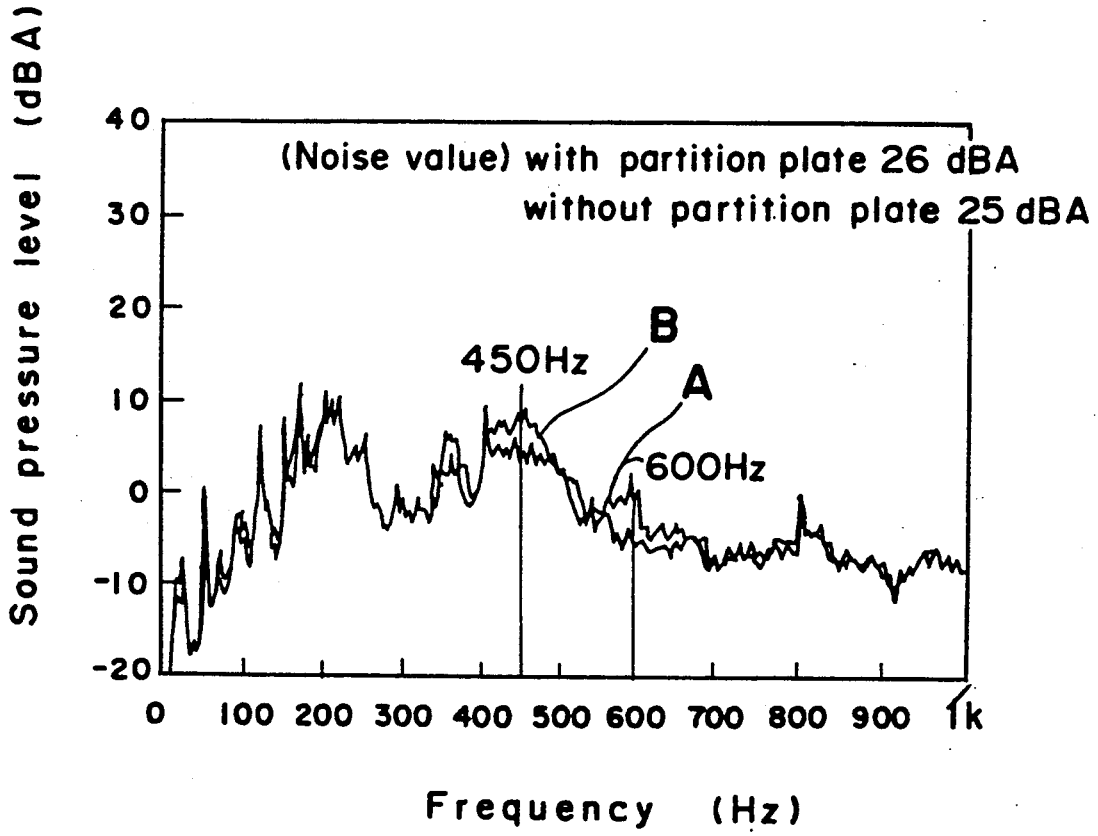
FIG. 4 is a diagram showing sound pressure levels (dBA) and noise values (dBA) at respective frequencies for the refrigerator provided with a partition plate and that not provided with a partition plate.

Results of the above measurements are shown in a graphical diagram of FIG. 4, in which the sound pressure levels (dBA) of the refrigerators (1) and (2) at the respective frequencies are represented by curves A and B.

From the above results, it has been found that, as compared with the refrigerator (2), in the refrigerator (1), the sound pressure level (dBA) is lowered in the frequency region at 450 Hz, while it is raised in the frequency region at 600 Hz. Thus, it has also been found that, with respect to the suction side space 7A of the refrigerator, the resonance frequency Fr may be made higher, for example, when the resonance dimension L is reduced as shown in the equation (1) described earlier.

In the refrigerator (1), the sound pressure level (dBA) in the vicinity of 450 Hz which is the frequency region not efficiently absorbed by the sound absorbing material 6A is lowered, while the sound pressure level (dBA) around 600 Hz which is the frequency region to be efficiently absorbed by the sound absorbing material 6A is raised. Accordingly, in the refrigerator (1), rising of the sound pressure level in the new frequency region (in the vicinity of 600 Hz) does not become a factor for raising the level of the noise on the whole. Thus, the nose value (dBA) of the refrigerator (1) is lowered from 26 dBA, which is the noise value (dBA) of the refrigerator (2), to 25 dBA.

From the above findings, it is considered that in the refrigerator, when the partition plate 8 is provided at the suction side space 7A, the resonance frequency Fr of said space 7A may be altered as desired, whereby it becomes possible to cause the noises generated in the suction side space 7A to agree with the frequency region which may be efficiently absorbed by the sound absorbing material 6A. Accordingly, since increase of thickness of the sound absorbing material 6A to a large extent or employment of a special material therefor is not required for the refrigerator, noise reduction may be achieved without involving cost increase.

It should be noted here that in the foregoing embodiment, although the resonance frequency Fr of the suction side space 7A is altered by providing the partition plate 8 in said space 7A, the concept of the present invention is not limited in its application to the above, but the arrangement may be so modified, for example, that the resonance frequency Fr of the suction side space 7A is altered by connecting the rear panel inner wall 9A with the fan fixing plate 10A, and forming said inner wall 9A into a concave shape so as to form the suction side space only at the portion where the air passing through the heat exchanger 4A flows towards the axial flow fan 3A.

As is clear from the foregoing description, according to the present invention, the refrigerator includes the cooling chamber having the refrigerating chamber and the freezing chamber, the send-out means for circulating air within said cooling chamber, the heat exchanger for cooling the air circulated by said send-out means, the suction side space so formed as to guide the air cooled by the heat exchanger from said heat-exchanger to the send-out means, and the sound absorbing material for absorbing noises produced in said suction side space and said cooling chamber so as not to leak outside the refrigerator, with said suction side space and said cooling chamber respectively having resonance dimensions for resonation at specific frequency regions. The suction side space is set, in its resonance dimension, to the frequency region at which the sound absorbing material can absorb the sound in an efficient manner.

In the above arrangement of the present invention, by setting at the frequency region at which the sound absorbing material efficiently absorbs noises in the suction side space, it becomes possible to sufficiently reduce the leakage of noises generated in the suction side space during operation, out of the refrigerator, without necessity for the increase of the thickness of the sound absorbing material layer to a large extent or employment of a special sound absorbing material which involves cost increase. Accordingly, noises to be produced during operation of the refrigerator may be reduced without increase in cost.

Although the present invention has been fully described by way of example with reference to the accompanying drawings, it is to be noted here that various changes and modifications will be apparent to those skilled in the art. Therefore, unless otherwise such changes and modifications depart from the scope of the present invention they should be construed as included therein.

What is claimed is:

1. A refrigerator comprising a cooling chamber including a refrigerating chamber and a freezing chamber, a send-out means for circulating air within said cooling chamber including an axial flow fan fixed on a fan fixing plate provided at an inner rear side of said freezing chamber, a heat exchanger for cooling the air circulated by said send-out means, a suction side space so formed as to guide the air cooled by the heat exchanger from said heat exchanger to the send-out means, said suction side space being defined between said fan fixing plate and an inner wall surface of a rear panel within the refrigerator, a sound absorbing material for absorbing noises produced in said suction side space and said cooling chamber so as to substantially preclude transmission of noise to the outside of the refrigerator, said suction side space and said cooling chamber respectively having resonance dimensions for resonation at specific frequency regions, and a partition plate in said suction side space and extending from said fan fixing plate to said inner wall surface of said rear panel for reducing noises produced in said suction side space, said partition plate being located to alter the resonance frequency for said suction side space thereby to set said suction side space, in its resonance dimension, to the frequency region at which the sound absorbing material can efficiently absorb the sound.

2. A refrigerator as claimed in claim 1, wherein said sound absorbing material is made of a porous material selected from a group consisting of glass wool, felt, expanded polyurethane and an iron plate.

3. A refrigerator as claimed in claim 1, wherein the resonance frequency of the suction side space is adapted to be altered by joining said fan fixing plate with the inner wall surface of the rear panel, and forming the inner wall surface of the rear panel into a concave shape only at its portion where air passing through the heat exchanger flows towards said axial flow fan.

4. A refrigerator according to claim 3 wherein said partition plate is integrally formed within an inner box constituting said rear panel.

5. A refrigerator comprising a cooling chamber including a refrigerating chamber and a freezing chamber, a send-out means for circulating air within said cooling chamber, a heat exchanger for cooling the air circulated by said send-out means, a suction side space so formed as to guide the air cooled by the heat exchanger from said heat exchanger to the send-out means, and a sound absorbing material for absorbing noises produced in said suction side space and said cooling chamber to substantially preclude transmission of noise to the outside of the refrigerator, said suction side space and said cooling chamber respectively having resonance dimensions for resonation at specific frequency regions and a partition plate in said suction side space for setting the resonance frequency of said suction side space in a frequency region substantially corresponding to the frequency region at which the sound absorbing material can efficiently absorb the sound.

6. A refrigerator according to claim 5 wherein said sound absorbing material is made of a porous material selected from a group consisting of glass wool, felt, expanded polyurethane and an iron plate.

* * * * *